US008042782B2

(12) United States Patent
Lippert et al.

(10) Patent No.: US 8,042,782 B2
(45) Date of Patent: Oct. 25, 2011

(54) LOUDSPEAKER BOX WALL HOLDER

(75) Inventors: Helmut Lippert, Breitenbrunn (DE); Peter Reichert, Urspringen (DE)

(73) Assignee: Koenig & Meyer GmbH & Co. KG, Wertheim (DE)

( * ) Notice: Subject to any disclaimer, the term of this patent is extended or adjusted under 35 U.S.C. 154(b) by 466 days.

(21) Appl. No.: 12/034,374

(22) Filed: Feb. 20, 2008

(65) Prior Publication Data

US 2008/0203254 A1 Aug. 28, 2008

(30) Foreign Application Priority Data

Feb. 23, 2007 (DE) ..... 10 2007 008 975

(51) Int. Cl.
*A47H 1/10* (2006.01)

(52) U.S. Cl. ..... 248/317; 248/222.13

(58) Field of Classification Search ..... 248/222.13, 248/316.2, 239, 284.1, 235, 280.11, 278.1, 248/317, 323, 324, 325, 221.11, 222.11, 248/222.12; 411/24, 26; 403/314, 350; 211/85.6, 211/87.01, 113, 117, 124
See application file for complete search history.

(56) References Cited

U.S. PATENT DOCUMENTS

| | | | | | |
|---|---|---|---|---|---|
| 2,483,758 | A | * | 10/1949 | Douglas | 248/242 |
| 2,712,039 | A | * | 6/1955 | Holmes | 379/455 |
| 2,867,918 | A | * | 1/1959 | Miller | 434/150 |
| 3,124,328 | A | * | 3/1964 | Kortsch | 248/118 |
| 3,485,382 | A | * | 12/1969 | Larson | 211/150 |
| 3,636,490 | A | * | 1/1972 | Pansing | 337/93 |
| 3,944,178 | A | * | 3/1976 | Greenwood | 248/231.61 |
| 4,036,459 | A | * | 7/1977 | Alexander et al. | 248/663 |
| 4,581,519 | A | * | 4/1986 | Thaler et al. | 219/225 |
| 5,263,802 | A | * | 11/1993 | Fichot et al. | 411/26 |
| 5,429,336 | A | * | 7/1995 | Ko | 248/278.1 |
| 5,664,900 | A | * | 9/1997 | Matthies | 403/297 |
| 5,704,578 | A | * | 1/1998 | Fischer | 248/288.51 |
| 6,012,886 | A | * | 1/2000 | Tanamura et al. | 411/24 |
| 6,068,227 | A | * | 5/2000 | Morgan et al. | 248/278.1 |
| 6,328,270 | B1 | * | 12/2001 | Elberbaum | 248/288.31 |
| 6,467,745 | B1 | * | 10/2002 | Sickels | 248/242 |
| 7,028,961 | B1 | * | 4/2006 | Dittmer et al. | 248/278.1 |
| 7,404,535 | B2 | * | 7/2008 | Mossman et al. | 248/323 |
| 7,562,852 | B2 | * | 7/2009 | Wang | 248/285.1 |
| 2003/0174855 | A1 | * | 9/2003 | Hawkins et al. | 381/386 |
| 2005/0100187 | A1 | | 5/2005 | Yang | |
| 2007/0075202 | A1 | * | 4/2007 | Gordon | 248/289.11 |

FOREIGN PATENT DOCUMENTS

WO 97/16097 5/1997

OTHER PUBLICATIONS

Proel Metal KP570 Wall Mount Speaker Stand, Catalog, p. 77, XP-002471414 http://web.archive.org/web/20061206055009/http://www.bandl.hu/pdf/audio/access/proel_kp555.pdf.

* cited by examiner

*Primary Examiner* — A. Joseph Wujciak, III
(74) *Attorney, Agent, or Firm* — Greenblum & Bernstein, P.L.C.

(57) ABSTRACT

Loudspeaker wall holder and method of mounting a loudspeaker box. The loudspeaker wall holder includes a base mountable on a wall surface, an arm coupled to the base, and a holder comprising a clamping device. The holder is mounted on the arm and is structured and arranged to receive a portion of a loudspeaker box. The instant abstract is neither intended to define the invention disclosed in this specification nor intended to limit the scope of the invention in any way.

15 Claims, 2 Drawing Sheets

Fig.1
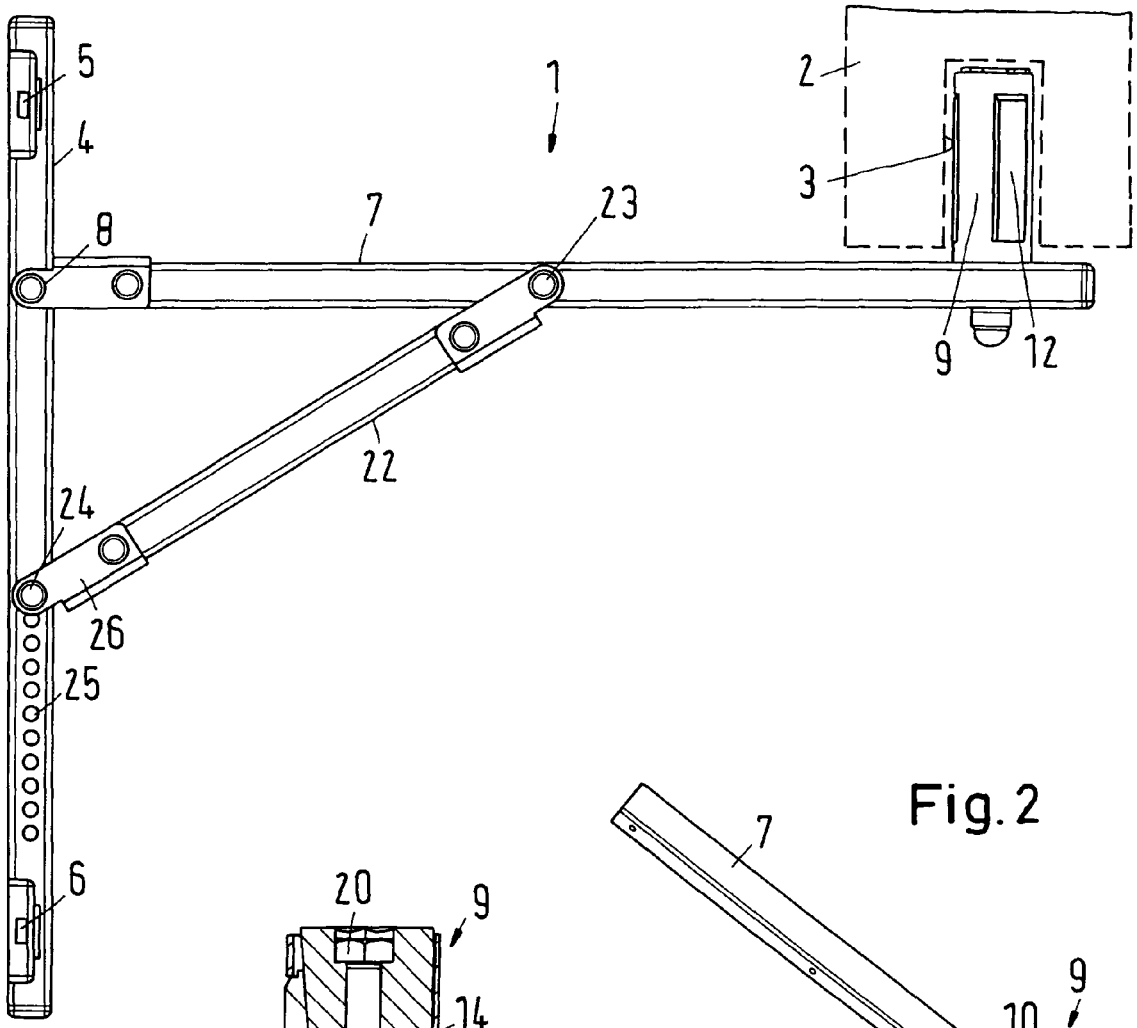
Fig.2
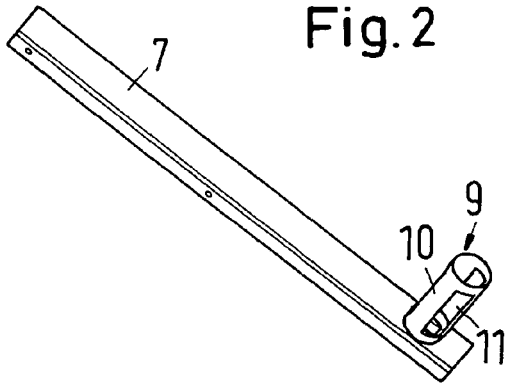
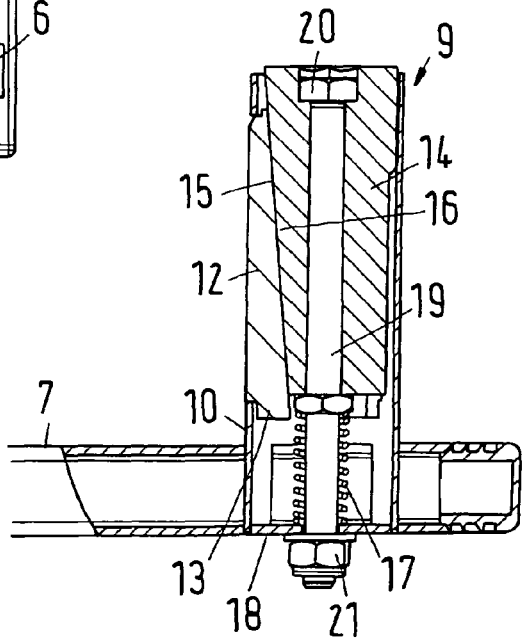
Fig.3

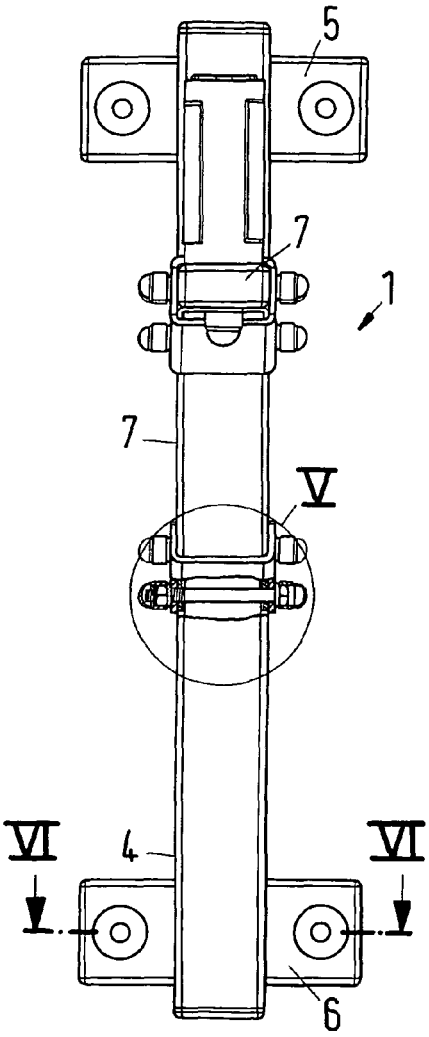
Fig.4
Fig.5
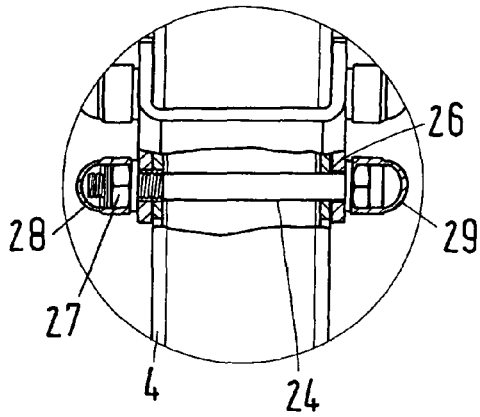
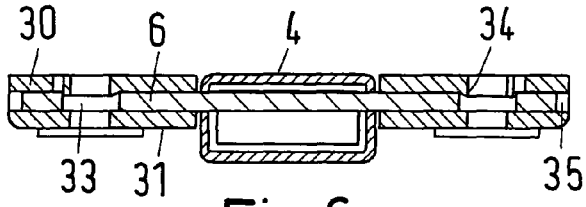
Fig.6
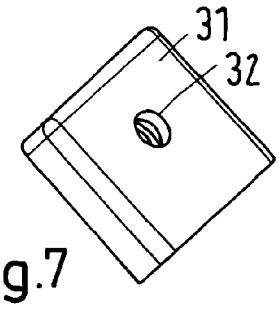
Fig.7

LOUDSPEAKER BOX WALL HOLDER

CROSS-REFERENCE TO RELATED APPLICATIONS

The present application claims priority under 35 U.S.C. § 119 of German Patent Application No. 10 2007 008 975.0 filed Feb. 23, 2007, the disclosure of which is expressly incorporated by reference herein in its entirety.

BACKGROUND OF THE INVENTION

1. Field of the Invention

The invention relates to a loudspeaker box wall holder with a base that can be mounted on a wall surface and an arm leading from the base, on which arm a holder is mounted, onto which a loudspeaker box can be slipped.

2. Discussion of Background Information

To fill rooms with sound, loudspeaker boxes are used that are frequently attached to a wall in the case of a stationary assembly. This has the advantage that they leave the floor of the room free for other furnishings or purposes. The arm thereby makes it possible for the loudspeaker box to be fastened with a predetermined spacing from the wall, which is advantageous in terms of acoustic factors.

Larger loudspeaker boxes sometimes have a considerable weight, often in the range of 8 to 65 kg. To position the loudspeaker box on the wall holder, the loudspeaker box often has a flange that is embodied in the broadest sense as a hollow cylinder. The loudspeaker box is slipped onto the holder with this flange. This mounting is generally also sufficient to prevent the loudspeaker box from falling off. Otherwise, however, the flange of the loudspeaker box has in part a considerable play with respect to the holder. The reason for this, among other things, is that loudspeaker boxes in Europe have a flange inside diameter of 35 mm, while, for example, loudspeaker boxes in the U.S. have an inside diameter of 1.5" or approx. 38 mm. Often the flanges are not embodied on the inside in an exactly hollow cylindrical manner, either, but have tapers, which occurs more frequently in particular when the flange is embodied as a casting.

Although the play between the loudspeaker box and the holder of the wall holder facilitates the placement and removal of the loudspeaker box, it has acoustic disadvantages. For example, some boxes tend to rattle when they are slipped onto the holder. Another problem is that not every wall is aligned exactly vertically. Consequently, it can happen that the arm is not aligned exactly horizontally. In this case it can happen that over the course of time the loudspeaker box changes its angular alignment that was set to fill the room with sound. In the course of operation, the loudspeaker box vibrates, which causes it to rotate into a position in which the center of gravity of the loudspeaker box has reached its lowest position.

SUMMARY OF THE INVENTION

The present invention securely mounts a loudspeaker box on a wall.

According to the invention, a loudspeaker box wall holder of the type mentioned at the outset includes a holder with a clamping device.

The loudspeaker box is braced with the clamping device with respect to the holder, so that in the assembled state there is no longer any play between the loudspeaker box, to be more precise its flange, and the holder. Correspondingly a rattling of the loudspeaker box during operation is avoided. Accidental rotating of the loudspeaker box, for example, when the holder is tilted with respect to the normal, can also be avoided. The clamping device holds the loudspeaker box firmly in a predetermined angular position. To this end it is necessary merely to place the loudspeaker box onto the holder in the desired angular position and to hold it in the desired angular position until the clamping device has been activated.

Preferably, the clamping device has at least one clamping element that is displaceable perpendicular to the placement direction of the loudspeaker box. This clamping element can be placed against the flange of the loudspeaker box with a certain force from inside upon actuation of the clamping device, thus eliminating a previously present play between the flange and the holder.

The loudspeaker box is then held by a clamping force between the clamping element and the flange. In many cases one clamping element will already be sufficient. However, in order to achieve a centric position of the flange of the loudspeaker box on the holder, it is expedient to use two or more clamping elements.

The clamping device preferably has an expanding mandrel with at least one wedge surface, which interacts with a counterwedge surface on the clamping element. When the expanding mandrel is displaced, for example by a tool acting from outside, the wedge surface interacts with the counterwedge surface and pushes the clamping element outwards, so that it bears from inside against the flange of the loudspeaker box. The expanding mandrel is thereby preferably moved in the placement direction of the loudspeaker box; that is, parallel to an axis of the flange. When the clamping element can no longer be moved any further in the radial direction, the loudspeaker box is fixed in the final position.

It is hereby preferred for the wedge surface and the counterwedge surface to be embodied as flat surfaces. The wedge surface and the counterwedge surface can bear flat against one another independent of the movement of the expanding mandrel so that relatively large expanding forces can be generated and transferred.

The expanding mandrel can preferably be pressed into the holder against the force of a spring. This supports the release of the loudspeaker box from the wall holder. The expanding mandrel can be moved, e.g., in that it has a thread section on which a thread nut acts. Twisting the thread nut then moves the expanding mandrel in the clamping direction. When the nut is released, the spring then supports a movement of the expanding mandrel into release position so that the clamping elements are retracted again. The loudspeaker box can then be lifted from the wall holder without much effort.

Preferably, the clamping element has a decoupling layer on its outside. The decoupling layer can be relatively thin. It must ensure only that a transfer of vibrations from the flange of the loudspeaker box to the clamping element and thus to the wall holder is reduced or even suppressed. This can already be achieved in many cases when the decoupling layer has a certain proportion of air.

This is achieved in a simple manner by embodying the decoupling layer as a flocking. A flocking gives the outside of the clamping element a velvety appearance. The decoupling properties of the decoupling layer can be adjusted via the adjustment of the parameters of the flocking.

Preferably, the arm is attached to the base by a hinge that renders possible a swivel movement of the arm with respect to the base. This can be used to adjust the inclination of the loudspeaker box with respect to the wall. The swivel movement thereby takes place about a pivot axis arranged approximately horizontally when the wall holder is installed correctly. An adjustable inclination of the loudspeaker box is desirable for some acoustic functions.

The arm is preferably supported with respect to the base by a support, wherein the support can be fixed on the base and/or on the arm at one of several mounting positions. The inclination of the arm with respect to the base can be changed by changing the mounting position. Base, arm and support form a triangle. If a different mounting position is chosen, the length of one side of this triangle is changed. Since the base is fixed to the wall, the angular allocation of the arm to the base is also changed by changing the length of the side.

Preferably, the support is attached to the base and/or the arm with the aid of a stud that is detachably arranged in the support. The stud can be easily removed, optionally after loosening a nut. The stud can then be drawn out of the support and the base or the support and the arm. The stud can then be used again at another mounting position. This means that several discrete mounting positions are available, so that the arm can be aligned at certain angles with respect to the base. However, since these angles can be chosen with a sufficiently small spacing from one another, a discrete change of the inclination of the arm is also sufficient.

Preferably, the base and/or the arm has a through hole for each mounting position. This facilitates assembly. The stud can be guided completely through the through hole and secured on the other side with a locking element, for example, a nut or a cotter pin.

Preferably, the base has several tabs, which are provided with a damping layer at least on their side facing away from the arm. The use of tabs makes it easier to mount the base on a wall surface. However, the base then bears on the wall surface with a larger surface extension which per se would promote a transfer of vibrations from the wall holder to the wall. If a damping layer is now arranged between the base, to be more precise, its tabs, and the wall, this type of transfer of vibrations can be prevented or at least reduced.

It is hereby preferred for the damping layer to be formed as part of a cap of a plastic material that is placed on the tab. In this case, there are two advantages. On the one hand, this makes production easier. The damping layer is connected to the base in a virtually positive manner. On the other hand, there is also a damping layer on the side from which a stud head bears against the tab, so that a transfer of vibrations from the wall holder to the wall can also be prevented with relatively high reliability by the stud.

The present invention is directed to a loudspeaker wall holder that includes a base mountable on a wall surface, an arm coupled to the base, and a holder comprising a clamping device. The holder is mounted on the arm and is structured and arranged to receive a portion of a loudspeaker box.

According to a feature of the invention, the holder can be structured and arranged to slip into the portion of the loudspeaker box.

In accordance with another feature of the invention, the clamping device can include at least one clamping element perpendicularly displaceable to a placement direction of the loudspeaker box onto the holder. The clamping device may further include an expanding mandrel with at least one wedge surface structured and arranged to interact with a counterwedge surface of the at least one clamping element. The at least one wedge surface and the counterwedge surface can be formed as flat surfaces. Further, the expanding mandrel may be pressable into the holder against a spring force, and at least one of the at least one clamping element and the expanding mandrel may include a plastic material. The holder can further include a tube, and the at least one clamping element and the expanding mandrel may be arranged in the tube. The clamping element may be movable radially outwardly through an opening of the tube.

According to still another feature of the invention, an outside of the at least one clamping element can have a decoupling layer. The decoupling layer may be formed as a flocking.

The wall holder can further include a hinge coupling the arm to the base, whereby the arm swivels with respect to the base. Further, the wall holder may also include a support fixable on at least one of the base and the arm at one of several mounting positions to support the arm with respect to the base. The wall holder may also include a stud arranged to detachably attach the support to at least one of the base and the arm. At least one of the base and the arm has a through hole for each mounting position.

According to the instant invention, the base can include several tabs having a damping layer at least on a side facing away from the arm. Moreover, the damping layer can be formed as part of a cap placeable on the tabs.

The invention is directed to a method for attaching a loudspeaker box to a holder. The method includes slipping a holder receiving portion of the loudspeaker box over the holder, and expanding at least a portion of the holder to fix the holder within the holder receiving portion.

According to a feature of the invention, the expanding can include drawing an expandable mandrel located within the holder in a first direction, whereby a clamping element is forced out of the holder to contact the holder receiving portion.

In accordance with still yet another feature of the present invention, the expandable mandrel is drawn against a spring force by rotating a nut located on an end of the holder.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 1 illustrates a side view of a loudspeaker box wall holder;

FIG. 2 illustrates an arm with a part of a holder;

FIG. 3 illustrates the holder in cross section;

FIG. 4 illustrates a front view of the wall holder;

FIG. 5 illustrates an enlargement of section V depicted in FIG. 4;

FIG. 6 illustrates a sectional view along line VI-VI depicted in FIG. 4; and FIG. 7 illustrates a plastic cap.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

FIG. 1 shows a wall holder 1 for a loudspeaker box 2, shown only diagrammatically by broken lines. The loudspeaker box usually has a flange 3, which is embodied or formed as a hollow cylinder. The diameter of this hollow cylinder is determined among other things by the origin of loudspeaker box 2. In the case of European loudspeaker boxes 2, the diameter is generally approx. 35 mm, while loudspeaker boxes from the U.S. are generally approx. 1.5" or 38 mm in diameter. Nevertheless, the present invention reliably supports all loudspeaker boxes on wall holder 1.

Wall holder 1 has a base 4 which can be attached to a wall. Base 4 is embodied or formed as a square tube with a rectangular cross section, as can be seen, e.g., in FIG. 6. A tab 5, 6 is arranged respectively in the area of the upper end and in the area of the lower end. The tabs 5, 6 are inserted through slots in base 4, in the width direction of the cross section.

An arm 7 is swivellingly or pivotably coupled on base 4 by a hinge. To this end, arm 7 is pivotably mounted with a stud 8 to base 4. Arm 7 can be pivoted relative to base 4 about an axis formed by stud 8.

Further, arm 7 bears a holder 9. As depicted in FIG. 2, holder 9 includes a tube 10 having several openings 11 arranged in a circumferential wall of tube 10. At least one and preferably several clamping elements 12 are arranged inside tube 10, and each clamping element 12 has an offset 13 provided on its lower end, which is located inside a closed circumferential area of tube 10. Above offset 13, clamping element 12 can projects radially outwards through opening 11. In the present exemplary embodiment three clamping elements 12 are provided distributed in the circumferential direction.

Holder 9 has a centrically arranged expanding mandrel 14, which has a number of wedge surfaces 15 corresponding to the number of clamping elements 12. Wedge surfaces 15 interact with counterwedge surfaces 16 that are provided on each clamping element 12. Wedge surface 15, as well as counterwedge surface 16, are embodied or formed as flat surfaces.

Expanding mandrel 14 is supported, via a compression spring 17, on a base 18, which closes tube 10 on its lower end. Base 18 can also be formed by a part of arm 7. As can be seen from FIG. 3, arm 7 can be embodied or formed as a tubular section, e.g., as a square tube.

A double-end stud 19 is inserted through expanding mandrel 14, stud head 20 of stud 19 acts on expanding mandrel 14 from above, i.e., against the force of compression spring 17. Stud head 20 is recessed in expanding mandrel 14.

The lower end of stud 19 projects beyond base 18 to receive a nut 21. By screwably tightening nut 21, stud 19 is drawn downwards against the force of compression spring 17, which moves expanding mandrel 14 with it. Clamping elements 12 are moved radially outwards through the downward movement of expanding mandrel 14 to bear against an inside of flange 3. Loudspeaker box 2 is held thereby against a translational movement as well as against a rotary movement. This has special advantages with respect to the ability to tilt arm 7 described below.

Arm 7 is supported with respect to base 4 by a support 22. Base 4, a section of arm 7, and support 22 are arranged to form a triangle. As support 22 is connected to arm 7 via a stud 23, support 22 can be pivoted with respect to arm 7 about an axis formed by stud 23.

Support 22 is connected to base 4 by another stud 24, which is arranged at the other end of support 22. As can be seen from FIG. 1, the base has several through holes 25. Each through hole 25 is able to accommodate stud 24. The inclination of arm 7 changes depending on which through hole 25 stud 24 is placed into, because the length of the side of the triangle formed by base 4 is changed. In the present exemplary embodiment, the angle can be changed in ten stages between 90° and 68°.

Since the loudspeaker box can be mounted in a torsionally stiff manner on holder 9, even a loudspeaker box installed in a tilted manner retains its angular position relative to arm 7. Clamping elements 12 prevent the loudspeaker box from rotating during operation such that its center of gravity lies at the lowest position in the direction of gravity.

Arm 22 has a tab 26 that grips around base 4 in a U-shaped manner. Stud 24 is then guided through tab 26 and base 4. Stud 24 can be secured by a nut 27. In turn, nut 27 can be covered by a covering hood 28. A covering hood 29 can also be provided on the head of the stud 24.

Tabs 5, 6 are provided with a damping layer 30 on a side facing away from arm 7. Damping layer 30 is formed by a cap 31 being pushed onto each end of tab 6. Cap 31 has a through hole 32, which in the pushed-on condition matches a through hole 33 in tab 6. A screw or a stud, which is used to mount wall holder 1 on the wall, bears against cap 31. At the same time, wall holder 1 is supported by damping layer 30 with respect to the wall, so that vibrations can be prevented with great reliability from being transferred from loudspeaker box 2 to the wall.

As can be seen in particular from FIG. 6, in the area of through hole 32, cap 31 is provided with a perimeter projection 34 directed inwards, which snaps into the through opening 33 so cap 31 cannot accidentally slip off tab 6. The projection is flexibly mounted on cap 31. Cap 31 can be gripped by a tool through an opening 35 in order to release projection 34 from through hole 33. Caps 31 fasten tab 6 onto the base at the side.

In a manner not shown in further detail, it can be expedient to provide the radially outer surface of the clamping elements 12 with a decoupling layer, e.g., a flocking or a layer of foamed plastic.

In the present exemplary embodiment, the different mounting positions for support 22 are arranged on base 4. However, it can also be provided to arrange these mounting positions on arm 7. It is also possible to provide arm 7 as well as base 4 with different mounting positions for studs 23, 24 in order to have a greater flexibility here in the choice of inclination angle for arm 7.

Wall holder 1 effects an excellent decoupling between loudspeaker box 2 and the wall. Vibrations that are generated by loudspeaker box 2 are damped by clamping elements 12 made of plastic and furthermore not transferred, or only to a damped extent, to arm 7 and subsequently to base 4. Caps 31 on tabs 5, 6 prevent the remaining vibrations from being transferred from base 4 to the wall, because they are likewise made of plastic and have a decoupling effect.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A loudspeaker wall holder comprising:

a base mountable on a wall surface;

an arm coupled to the base;

a holder mounted on the arm comprising a clamping device and being structured and arranged to receive a portion of a loudspeaker box, wherein the holder is structured and arranged to slip into the portion of the loudspeaker box, wherein the clamping device comprises at least one clamping element perpendicularly displaceable to a placement direction of the loudspeaker box onto the holder, and wherein the clamping device further comprises an expanding mandrel with at least one wedge surface structured and arranged to interact with a counterwedge surface of the at least one clamping element.

2. The wall holder in accordance with claim 1, wherein the at least one wedge surface and the counterwedge surface are formed as flat surfaces.

3. The wall holder in accordance with claim 1, wherein the expanding mandrel is pressable into the holder against a spring force.

4. The wall holder in accordance with claim 1, wherein at least one of the at least one clamping element and the expanding mandrel comprise a plastic material.

5. The wall holder in accordance with claim 4, wherein the holder further comprises a tube, and the at least one clamping element and the expanding mandrel are arranged in the tube.

6. The wall holder in accordance with claim 5, wherein the clamping element is movable radially outwardly through an opening of the tube.

7. The wall holder in accordance with claim 1, wherein an outside of the at least one clamping element has a decoupling layer.

8. The wall holder in accordance with claim 7, wherein the decoupling layer is formed as a flocking.

9. The wall holder in accordance with claim 1, further comprising a hinge coupling the arm to the base, whereby the arm swivels with respect to the base.

10. The wall holder in accordance with claim 9, further comprising a support fixable on at least one of the base and the arm to support the arm with respect to the base at one of several mounting positions.

11. The wall holder in accordance with claim 10, further comprising a stud arranged to detachably attach the support to at least one of the base and the arm.

12. The wall holder in accordance with claim 10, wherein at least one of the base and the arm has a through hole for each mounting position.

13. The wall holder in accordance with claim 1, wherein the base includes several tabs having a damping layer at least on a side facing away from the arm.

14. The wall holder in accordance with claim 13, wherein the damping layer is formed as part of a cap placeable on the tabs.

15. The wall holder in accordance with claim 1, wherein the clamping device is structured and arranged to be expandable within the portion of the speaker.

* * * * *